US011341908B2

(12) United States Patent
Dong

(10) Patent No.: US 11,341,908 B2
(45) Date of Patent: May 24, 2022

(54) PIXEL CIRCUIT AND DRIVING METHOD THEREOF, DISPLAY PANEL AND DISPLAY DEVICE

(71) Applicant: BOE TECHNOLOGY GROUP CO., LTD., Beijing (CN)

(72) Inventor: Tian Dong, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 599 days.

(21) Appl. No.: 16/327,653

(22) PCT Filed: Aug. 24, 2018

(86) PCT No.: PCT/CN2018/102261
§ 371 (c)(1),
(2) Date: Feb. 22, 2019

(87) PCT Pub. No.: WO2019/109673
PCT Pub. Date: Jun. 13, 2019

(65) Prior Publication Data

US 2021/0327344 A1 Oct. 21, 2021

(30) Foreign Application Priority Data

Dec. 6, 2017 (CN) ..... 201711278159.X

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01);
(Continued)

(58) Field of Classification Search
CPC .. G09G 3/3208; G09G 3/3233; G09G 3/3258; G09G 2300/0819;
(Continued)

(56) References Cited

U.S. PATENT DOCUMENTS

2014/0111404 A1 4/2014 Omata et al.
2016/0093251 A1* 3/2016 Chung ..... G01J 1/0403 345/207

(Continued)

FOREIGN PATENT DOCUMENTS

CN 103779385 A 5/2014
CN 105096831 A 11/2015

(Continued)

OTHER PUBLICATIONS

International Search Report of PCT/CN2018/102261 in Chinese, dated Nov. 20, 2018, with English translation.

(Continued)

*Primary Examiner* — Stacy Khoo

(74) *Attorney, Agent, or Firm* — Collard & Roe, P.C.

(57) ABSTRACT

A pixel circuit and a driving method thereof, a display panel and a display device are provided. The pixel circuit includes a drive circuit, a first reset bias circuit, and a second reset bias circuit. A control terminal of the drive circuit is electrically connected to the first reset bias circuit, a first terminal of the drive circuit is electrically connected to the second reset bias circuit; the first reset bias circuit is further electrically connected to a first control terminal and a first bias voltage terminal; the second reset bias circuit is further electrically connected to a bias control terminal and a second bias voltage terminal; the first reset bias circuit and the second reset bias circuit are configured to control the drive circuit to be in a bias state during a reset phase.

18 Claims, 11 Drawing Sheets

(52) U.S. Cl.
CPC ..... *G09G 2300/0842* (2013.01); *G09G 2320/0233* (2013.01); *G09G 2320/0257* (2013.01)

(58) Field of Classification Search
CPC ... G09G 2300/0842; G09G 2300/0861; G09G 2310/0251; G09G 2310/0262; G09G 2320/0204; G09G 2320/0233; G09G 2320/043; G09G 2320/045; G09G 3/3291
See application file for complete search history.

(56) References Cited

U.S. PATENT DOCUMENTS

| | | | |
|---|---|---|---|
| 2016/0180775 | A1 | 6/2016 | Kim |
| 2019/0005877 | A1 | 1/2019 | Dong |
| 2019/0035332 | A1 | 1/2019 | Liu |
| 2019/0189057 | A1 | 6/2019 | Dong |

FOREIGN PATENT DOCUMENTS

| | | | |
|---|---|---|---|
| CN | 105845081 | A | 8/2016 |
| CN | 106940983 | A | 7/2017 |
| CN | 107331345 | A | 11/2017 |
| CN | 107358918 | A | 11/2017 |
| CN | 107863072 | A | 3/2018 |

OTHER PUBLICATIONS

Notice of Transmittal of the International Search Report of PCT/CN2018/102261 in Chinese, dated Nov. 20, 2018.
Written Opinion of the International Searching Authority of PCT/CN2018/102261 in Chinese, dated Nov. 20, 2018 with English translation.
European Search Report in European Patent Application No. 18847206.2 dated Jul. 15, 2021.

* cited by examiner

PIXEL CIRCUIT AND DRIVING METHOD THEREOF, DISPLAY PANEL AND DISPLAY DEVICE

CROSS REFERENCE TO RELATED APPLICATIONS

This application is the National Stage of PCT/CN2018/102261 filed on Aug. 24, 2018, which claims priority under 35 U.S.C. § 119 of Chinese Application No. 201711278159.X filed on Dec. 6, 2017, the disclosure of which is incorporated by reference.

TECHNICAL FIELD

Embodiments of the present disclosure relate to a pixel circuit and a driving method thereof, a display panel and a display device.

BACKGROUND

Organic light emitting diode (OLED) display devices have advantages of self-luminescence, high contrast, low energy consumption, wide viewing angle, fast response, being capable to be used in a flexible panel, wide using temperature range, simple manufacture and so on, and have broad development prospects. As a new generation of display methods, OLED display panels can be widely used in devices with display functions, such as mobile phones, displays, notebook computers, digital cameras, instrumentations and so on.

SUMMARY

At least one embodiment of the present disclosure provides a pixel circuit, which comprises a light emitting component, a drive circuit, a first reset bias circuit, and a second reset bias circuit. A control terminal of the drive circuit is electrically connected to a data signal terminal and a second terminal of the first reset bias circuit, a first terminal of the drive circuit is electrically connected to a second terminal of the second reset bias circuit, and a second terminal of the drive circuit is electrically connected to the light emitting component; a control terminal of the first reset bias circuit is electrically connected to a first control terminal, and a first terminal of the first reset bias circuit is electrically connected to a first bias voltage terminal; a control terminal of the second reset bias circuit is electrically connected to a bias control terminal, and a first terminal of the second reset bias circuit is electrically connected to a second bias voltage terminal; and the first reset bias circuit and the second reset bias circuit are configured to reset the drive circuit and control the drive circuit to be in a bias state during a reset phase.

For example, in the pixel circuit provided by an embodiment of the present disclosure, the drive circuit comprises a drive transistor, the first reset bias circuit comprises a first bias transistor, and the second reset bias circuit comprises a second bias transistor, the control terminal of the drive circuit is a gate electrode of the drive transistor, the first terminal of the drive circuit is a first electrode of the drive transistor, and the second terminal of the drive circuit is a second electrode of the drive transistor, the first terminal of the first reset bias circuit is a first electrode of the first bias transistor, the second terminal of the first reset bias circuit is a second electrode of the first bias transistor, and the control terminal of the first reset bias circuit is a gate electrode of the first bias transistor, and the first terminal of the second reset bias circuit is a first electrode of the second bias transistor, the second terminal of the second reset bias circuit is a second electrode of the second bias transistor, and the control terminal of the second reset bias circuit is a gate electrode of the second bias transistor.

For example, the pixel circuit provided by an embodiment of the present disclosure further comprises a data write circuit and a storage circuit. The data write circuit is configured to write a data signal to the gate electrode of the drive transistor during a data writing phase; and the storage circuit is configured to store the data signal and maintain the data signal at the gate electrode of the drive transistor.

For example, the pixel circuit provided by an embodiment of the present disclosure further comprises a threshold compensation circuit. The threshold compensation circuit is configured to write a threshold compensation signal to the gate electrode of the drive transistor during the data writing phase.

For example, in the pixel circuit provided by an embodiment of the present disclosure, the threshold compensation circuit comprises a threshold compensation transistor, the data write circuit comprises a data write transistor, and the storage circuit comprises a storage capacitor, a first electrode of the threshold compensation transistor is electrically connected to a second electrode of the data write transistor, a second electrode of the threshold compensation transistor and a gate electrode of the threshold compensation transistor are electrically connected with each other, and are electrically connected to the gate electrode of the drive transistor; a first electrode of the data write transistor is electrically connected to the data signal terminal, and a gate electrode of the data write transistor is electrically connected to a second control terminal; and a first terminal of the storage capacitor is electrically connected to the first electrode of the drive transistor, and a second terminal of the storage capacitor is electrically connected to the gate electrode of the drive transistor.

For example, the pixel circuit provided by an embodiment of the present disclosure further comprises a voltage drop compensation circuit. The voltage drop compensation circuit is configured to write a reference voltage signal to the first electrode of the drive transistor during the data writing phase.

For example, in the pixel circuit provided by an embodiment of the present disclosure, the voltage drop compensation circuit comprises a voltage drop compensation transistor, and the storage circuit comprises a storage capacitor, a first electrode of the voltage drop compensation transistor is electrically connected to a reference power terminal, a second electrode of the voltage drop compensation transistor is electrically connected to the first electrode of the drive transistor, and a gate electrode of the voltage drop compensation transistor is electrically connected to a second control terminal; and a first terminal of the storage capacitor is electrically connected to the first electrode of the drive transistor, and a second terminal of the storage capacitor is electrically connected to the gate electrode of the drive transistor.

For example, the pixel circuit provided by an embodiment of the present disclosure further comprises a light emitting control circuit, the light emitting control circuit is configured to control the drive circuit to drive the light emitting component to emit light.

For example, in the pixel circuit provided by an embodiment of the present disclosure, the light emitting control circuit comprises a first control transistor and a second control transistor, a first electrode of the first control transistor is electrically connected to the second electrode of the drive transistor, a second electrode of the first control transistor is electrically connected to the light emitting component, and a gate electrode of the first control transistor is electrically connected to a third control terminal, and a first electrode of the second control transistor is electrically connected to a first power voltage terminal, a second electrode of the second control transistor is electrically connected to the first electrode of the drive transistor, and a gate electrode of the second control transistor is configured to receive a light emitting control signal.

For example, in the pixel circuit provided by an embodiment of the present disclosure, the gate electrode of the second control transistor is electrically connected to the third control terminal to receive the light emitting control signal, the gate electrode of the second bias transistor is electrically connected to the first control terminal, the first electrode of the second bias transistor is electrically connected to a reset voltage terminal, the reset voltage terminal is the second bias voltage terminal, and the first control terminal is the bias control terminal.

For example, in the pixel circuit provided by an embodiment of the present disclosure, a signal output by the first bias voltage terminal is same as a signal output by the second bias voltage terminal.

For example, in the pixel circuit provided by an embodiment of the present disclosure, the second bias transistor is multiplexed into the second control transistor.

For example, in the pixel circuit provided by an embodiment of the present disclosure, the second bias transistor is an N-type transistor, the gate electrode of the second bias transistor is electrically connected to the second control terminal, the first power voltage terminal is the second bias voltage terminal, and the second control terminal is the bias control terminal.

At least one embodiment of the present disclosure further provides a display panel, which comprises any one of the above pixel circuits.

At least one embodiment of the present disclosure further provides a display device, which comprises the above display panel.

At least one embodiment of the present disclosure provides a driving method of any one of the above pixel circuits, which comprises: during the reset phase, resetting the drive circuit and controlling the drive circuit to be in the bias state; during a data writing phase, writing a data signal to the drive circuit; and during a light emitting phase, driving the light emitting component to emit light.

For example, in the driving method provided by an embodiment of the present disclosure, the drive circuit comprises a drive transistor, the first reset bias circuit comprises a first bias transistor, and the second reset bias circuit comprises a second bias transistor; the resetting the drive circuit and controlling the drive circuit to be in a bias state comprises: writing a first bias voltage signal to a gate electrode of the drive transistor through the first bias transistor; and writing a second bias voltage signal to a first electrode of the drive transistor through the second bias transistor. The drive transistor is controlled to be in the bias state by a difference between the first bias voltage signal and the second bias voltage signal.

For example, in the driving method provided by an embodiment of the present disclosure, the first bias voltage signal and the second bias voltage signal are same.

For example, in the driving method provided by an embodiment of the present disclosure, a first electrode of the second bias transistor is electrically connected to a first power voltage terminal to receive a first power voltage signal, and the first power voltage signal is the second bias voltage signal.

For example, the driving method provided by an embodiment of the present disclosure further comprises: during the data writing phase, writing a threshold compensation signal to the gate electrode of the drive transistor through a threshold compensation circuit.

For example, the driving method provided by an embodiment of the present disclosure further comprises: during the data writing phase, writing a reference voltage signal to the first electrode of the drive transistor through a voltage drop compensation circuit.

BRIEF DESCRIPTION OF THE DRAWINGS

In order to clearly illustrate the technical solution of the embodiments of the disclosure, the drawings used in the description of the embodiments or relevant technologies will be briefly described in the following; it is obvious that the described drawings are only related to some embodiments of the disclosure and thus are not limitative of the disclosure.

DETAILED DESCRIPTION

Figure 1:
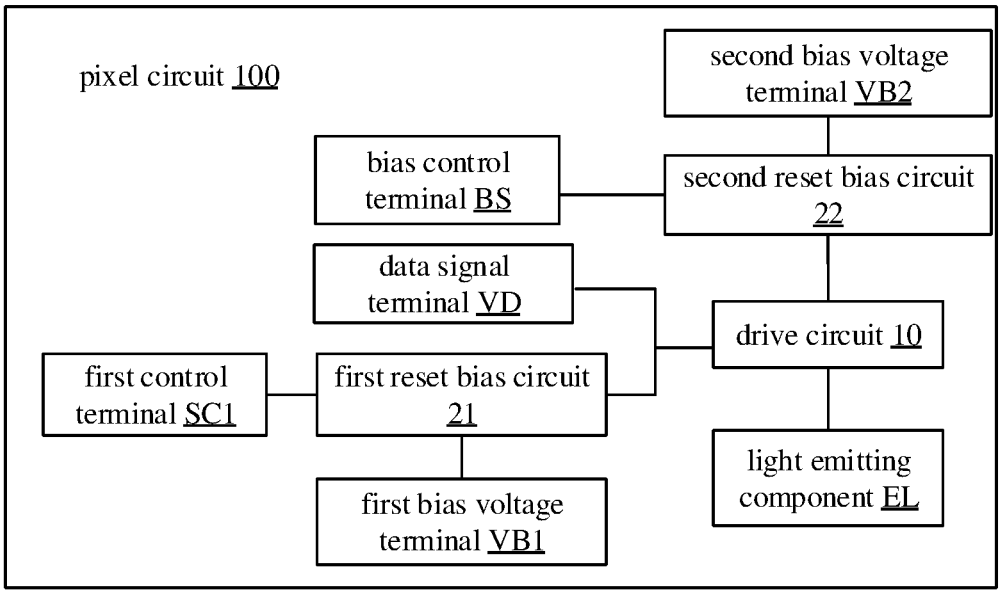
FIG. 1 is a schematic block diagram of a pixel circuit provided by an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms “first,” “second,” etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

In order to keep the following description of embodiments of the present disclosure clear and concise, the present disclosure omits detailed descriptions of known functions and known components.

As a size of an organic light emitting diode (OLED) display panel increases, a problem of the power voltage drop (IR drop) of the OLED display panel becomes more and more serious, resulting in uneven display brightness of the OLED display panel, which affects a display effect of the OLED display panel.

Each pixel on the OLED display panel is driven by a plurality of thin film transistors (TFTs), and TFT driving technology can improve display speed, contrast and brightness, and improve resolution. However, the TFT has a hysteresis effect. The hysteresis effect of the TFT is an uncertainty presented based on the electrical characteristics of the TFT under a certain bias voltage, that is, a current flowing through the TFT is not only related to the current bias voltage, but also related to the state of the TFT at the previous moment. The hysteresis effect of the TFT is related to the gate dielectric of the TFT, the semiconductor material of the TFT and the interface state trap therebetween. The hysteresis effect of the TFT causes a short-term afterimage, and an image of a previous frame are generally remained in an image of a next frame, thereby affecting the display quality of the OLED display panel, and even causing display errors.

At least one embodiment of the present disclosure provides a pixel circuit and a driving method thereof, a display panel and a display device. The drive circuit is allowed to be in a bias state during a reset phase, so that when an image is displayed, the drive circuit is changed from the bias state to a corresponding display state, a data voltage of a display image in a next frame is not affected by a data voltage of a display image in a previous frame, thereby ameliorating a short-term afterimage problem caused by the hysteresis effect, and improving the display quality of the display panel. In addition, the driving method of the pixel circuit provided by the embodiments of the present disclosure may further perform a threshold compensation operation and a voltage drop compensation operation, thereby compensating for threshold voltage drift of the drive transistor and power voltage drop (IR drop) of the display panel, thereby improving display uniformity, and effectively improving the display effect of the display panel.

Some embodiments of the present disclosure are described in detail below, but the present disclosure is not limited to the specific embodiments.

Figure 2:
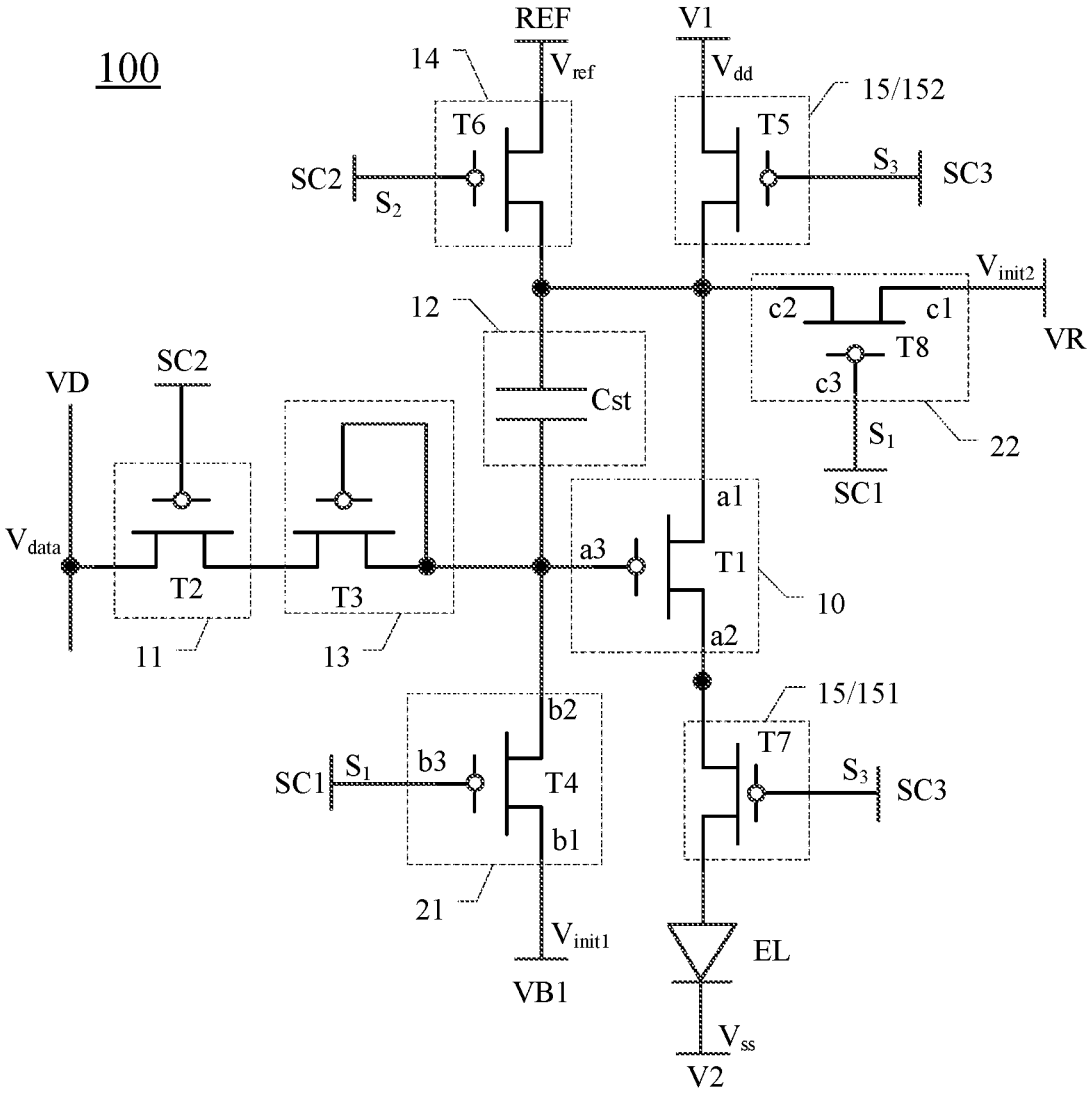
FIG. 2 is a structural schematic diagram of a pixel circuit provided by an embodiment of the present disclosure.

FIG. 1 is a schematic block diagram of a pixel circuit provided by an embodiment of the present disclosure. FIG. 2 is a structural schematic diagram of a pixel circuit provided by an embodiment of the present disclosure.

For example, as illustrated in FIG. 1, a pixel circuit 100 provided by the embodiment of the present disclosure may comprise a light emitting component EL, a drive circuit 10, a first reset bias circuit 21, and a second reset bias circuit 22. A control terminal of the drive circuit 10 is respectively electrically connected to a data signal terminal VD and a second terminal of the first reset bias circuit 21, a first terminal of the drive circuit 10 is electrically connected to a second terminal of the second reset bias circuit 22, and a second terminal of the drive circuit 10 is electrically connected to the light emitting component EL. A control terminal of the first reset bias circuit 21 is electrically connected to a first control terminal SC1, a first terminal of the first reset bias circuit 21 is electrically connected to a first bias voltage terminal VB1. A control terminal of the second reset bias circuit 22 is electrically connected to a bias control terminal BS, and a first terminal of the second reset bias circuit 22 is electrically connected to a second bias voltage terminal VB2. The first reset bias circuit 21 and the second reset bias circuit 22 are configured to reset the drive circuit 10 and control the drive circuit 10 to be in a bias state during a reset phase.

For example, the pixel circuit 100 provided by the embodiment of the present disclosure can be applied to a display panel, such as an active matrix organic light emitting diode (AMOLED) display panel or the like.

For example, the light emitting component EL is configured to emit light when a voltage or current is applied thereto. The light emitting component EL can be an organic light emitting component, and the organic light emitting component can be, for example, an organic light emitting diode, but embodiments of the present disclosure are not limited thereto. The light emitting component EL can, for example, adopt different light emitting materials to emit light of different colors, so as to perform colorful luminescence.

For example, specific structures of the drive circuit 10, the first reset bias circuit 21, and the second reset bias circuit 22 can be set according to actual application requirements, which are not specifically limited in the embodiments of the present disclosure. For example, the pixel circuit 100 provided by the embodiments of the present disclosure can be implemented as a circuit structure illustrated in FIG. 2.

For example, as illustrated in FIG. 2, in an embodiment, the drive circuit 10 comprises a drive transistor T1. The control terminal a3 of the drive circuit 10 is s gate electrode of the drive transistor T1, the first terminal a1 of the drive circuit 10 is a first electrode of the drive transistor T1, and the second terminal a2 of the drive circuit 10 is a second electrode of the drive transistor T1. "The drive circuit 10 being in a bias state" may indicate that the drive transistor T1 is in a bias state, that is, the first reset bias circuit 21 and the second reset bias circuit 22 may control the drive transistor T1 to be in the bias state during the reset phase.

For example, the drive transistor T1 is a P-type transistor. The first electrode of the drive transistor T1 may be a source electrode, and the second electrode of the drive transistor T1 may be a drain electrode. In the description of the present disclosure, "the drive transistor T1 being in a bias state" may indicate that a voltage difference between the gate electrode of the drive transistor T1 and the source electrode of the drive transistor T1 is not greater than a voltage difference Vgs255 between the gate electrode and the source electrode, in which Vgs255 corresponds to the maximum gray scale (ie, 255 gray scale). That is, the Vgs (i.e., the voltage difference between the gate electrode of the drive transistor T1 and the source electrode of the drive transistor T1) of the drive transistor T1 is less than or equal to Vgs255. "The drive transistor T1 being in a bias state" may also indicate that the voltage difference between the gate electrode of the drive transistor T1 and the source electrode of the drive transistor T1 is not less than a threshold voltage $V_{th1}$ of the drive transistor T1, that is, the Vgs of the drive transistor T1 is greater than or equal to $V_{th1}$.

For example, the first reset bias circuit 21 is configured to write a first bias voltage signal to the gate electrode of the drive transistor T1 during the reset phase; and the second reset bias circuit 22 is configured to write a second bias voltage signal to the first electrode of drive transistor T1 during the reset phase. A difference between the first bias voltage signal and the second bias voltage signal controls the drive transistor T1 to be in the bias state. During the reset phase, the first bias voltage signal and the second bias voltage signal are respectively a gate voltage and a source voltage of the drive transistor T1, so that a voltage difference between the first bias voltage signal and the second bias voltage signal (For example, the voltage difference represents a difference obtained by subtracting the second bias voltage signal from the first bias voltage signal) is greater than or equal to $V_{th1}$; alternatively, the voltage difference is less than or equal to Vgs255.

For example, as illustrated in FIG. 2, the first reset bias circuit 21 comprises a first bias transistor T4. The first terminal b1 of the first reset bias circuit 21 is a first electrode of the first bias transistor T4, the second terminal b2 of the first reset bias circuit 21 is a second electrode of the first bias transistor T4, and the control terminal b3 of the first reset bias circuit 21 is a gate electrode of the first bias transistor T4. The second reset bias circuit 22 comprises a second bias transistor T8. The first terminal c1 of the second reset bias circuit 22 is a first electrode of the second bias transistor T8, the second terminal c2 of the second reset bias circuit 22 is a second electrode of the second bias transistor T8, and the control terminal c3 of the second reset bias circuit 22 is a gate electrode of the second bias transistor T8.

For example, the first bias voltage terminal VB1 is configured to output a first bias voltage signal $V_{init1}$, and the second bias voltage terminal VB2 is configured to output a second bias voltage signal $V_{init2}$.

For example, the gate electrode of the first bias transistor T4 is electrically connected to the first control terminal SC1 to receive a first control signal $S_1$, and the first electrode of the first bias transistor T4 is electrically connected to the first bias voltage terminal VB1 to receive the first bias voltage signal $V_{init1}$. The second electrode of the first bias transistor T4 is electrically connected to the gate electrode of the drive transistor T1 to transmit the first bias voltage signal $V_{init1}$ to the gate electrode of the drive transistor T1 when the first bias transistor T4 is turned on.

For example, as illustrated in FIG. 2, the gate electrode of the second bias transistor T8 is electrically connected to the first control terminal SC1, the first electrode of the second bias transistor T8 is electrically connected to a reset voltage terminal VR, and the second electrode of the second bias transistor T8 is electrically connected to the first electrode of the drive transistor T1. The first control terminal SC1 is the bias control terminal BS, and the reset voltage terminal VR is the second bias voltage terminal VB2. During the reset phase, the first control terminal SC1 can output the first control signal $S_1$, and the first control signal $S_1$ is a bias control signal. The reset voltage terminal VR can output the second bias voltage signal $V_{init2}$, and the first electrode of the second bias transistor T8 can receive the second bias voltage signal $V_{init2}$, so that the second bias voltage signal $V_{init2}$ can be transmitted to the first electrode of the drive transistor T1 when the second bias transistor T8 is turned on.

For example, in the embodiment illustrated in FIG. 2, a type of the first bias transistor T4 and a type of the second bias transistor T8 are same. The first bias transistor T4 and the second bias transistor T8, for example, are both P-type transistors, and the gate electrode of the first bias transistor T4 and the gate electrode of the second bias transistor T8 are both electrically connected to the first control terminal SC1 and are controlled by the same first control signal $S_1$, so that the number of signal control terminals can be reduced. The first bias transistor T4 and the second bias transistor T8 operate simultaneously under the control of the first control signal $S_1$. It should be noted that the gate electrode of the first bias transistor T4 and the gate electrode of the second bias transistor T8 may also be electrically connected to different signal control terminals respectively to receive different control signals, as long as the first bias transistor T4 and the second bias transistor T8 can operate simultaneously during the reset phase.

It should be noted that the type of the first bias transistor T4 and the type of the second bias transistor T8 may also be different, which are not limited in the present disclosure.

For example, the first bias voltage signal $V_{init1}$ and the second bias voltage signal $V_{init2}$ may be equal to each other, so that the first electrode of the first bias transistor T4 and the first electrode of the second bias transistor T8 may both be electrically connected to the same bias voltage terminal (for example, the first bias voltage terminal VB1 or the second bias voltage terminal VB2), that is, the pixel circuit 100 may comprise only one bias voltage terminal, thereby reducing the number of bias voltage terminals and reducing production cost. The present disclosure are not limited in this aspect. The first bias voltage signal $V_{init1}$ and the second bias voltage signal $V_{init2}$ may not be equal to each other, as long as the difference between the first bias voltage signal $V_{init1}$ and the second bias voltage signal $V_{init2}$ is greater than or equal to $V_{th1}$; alternatively, the difference between the first bias voltage signal $V_{init1}$ and the second bias voltage signal $V_{init2}$ is less than or equal to Vgs255 (ie, $V_{init1}$-$Vi_{nit2} \leq$Vgs255, or $V_{init1}-V_{init2} \geq V_{th1}$). The present disclosure does not limit this specifically.

For example, as illustrated in FIG. 2, the pixel circuit 100 may further comprise a data write circuit 11 and a storage circuit 12. The data write circuit 11 is configured to write a data signal to the gate electrode of the drive transistor T1 during a data writing phase; and the storage circuit 12 is configured to store the data signal and maintain the data signal at the gate electrode of the drive transistor T1.

For example, the storage circuit 12 comprises a storage capacitor Cst. A first terminal of the storage capacitor Cst is electrically connected to the first electrode of the drive transistor T1, and a second terminal of the storage capacitor Cst is electrically connected to the gate electrode of the drive transistor T1. That is, the second electrode of the first bias transistor T4 is electrically connected to the second terminal of the storage capacitor Cst, and the second electrode of the second bias transistor T8 is electrically connected to the first terminal of the storage capacitor Cst. Therefore, during the reset phase, the first terminal of the storage capacitor Cst can store the second bias voltage signal $V_{init2}$ and maintain the second bias voltage signal $V_{init2}$ at the first electrode of the drive transistor T1, and the second terminal of the storage capacitor Cst can store the first bias voltage signal $V_{init1}$ and maintain the first bias voltage signal $V_{init1}$ at the gate electrode of drive transistor T1.

For example, the pixel circuit 100 may further have an electrical compensation function according to actual application requirements. The electrical compensation function can be implemented by voltage compensation, current compensation or hybrid compensation.

For example, as illustrated in FIG. 2, the pixel circuit 100 may further comprise a threshold compensation circuit 13. The threshold compensation circuit 13 is configured to write a threshold compensation signal to the gate electrode of the drive transistor T1 during the data writing phase to compensate for the drift of the threshold voltage $V_{th1}$ of the drive transistor T1. Therefore, the pixel circuit 100 provided by the embodiments of the present disclosure can compensate for the threshold voltage drift of the drive transistor T1, thereby improving display uniformity and display effect.

For example, the threshold compensation circuit 13 may comprise a threshold compensation transistor T3, and the data write circuit 11 may comprise a data write transistor T2. As illustrated in FIG. 2, a first electrode of the threshold compensation transistor T3 is electrically connected to a second electrode of the data write transistor T2, and a second electrode of the threshold compensation transistor T3 and a gate electrode of the threshold compensation transistor T3 are electrically connected to each other and are electrically connected to the gate electrode of the drive transistor T1. A first electrode of the data write transistor T2 is electrically connected to the data signal terminal VD, and a gate electrode of the data write transistor T2 is electrically connected to the second control terminal SC2.

For example, the threshold compensation transistor T3 and the drive transistor T1 are same, that is, types, manufacture processes, and the like of the threshold compensation transistor T3 and the drive transistor T1 are same, thereby ensuring that a threshold voltage $V_{th2}$ of the threshold compensation transistor T3 and the threshold voltage $V_{th1}$ of the drive transistor T1 are same. The threshold compensation transistor T3 is also, for example, a P-type transistor.

For example, the first bias voltage signal $V_{init1}$ needs to be smaller than a sum of the threshold voltage $V_{th2}$ of the threshold compensation transistor T3 and the data signal $V_{data}$. That is, the first bias voltage signal $V_{init1}$ needs to satisfy the following formula: $V_{init1}<V_{th2}+V_{data}$. Because the threshold voltage $V_{th2}$ of the threshold compensation transistor T3 is the same as the threshold voltage $V_{th1}$ of the drive transistor T1, that is, $V_{init1}<V_{th1}+V_{data}$.

For example, during the data writing phase, the second control terminal SC2 may provide a second control signal $S_2$ to the gate electrode of the data write transistor T2 to turn on the data write transistor T2. The data signal terminal VD can provide a data signal $V_{data}$ to the first electrode of the data write transistor T2. Because the second electrode and the gate electrode of the threshold compensation transistor T3 are electrically connected to each other, the threshold compensation transistor T3 is turned on. Therefore, the data signal $V_{data}$ provided by the data signal terminal VD can charge the second terminal of the storage capacitor Cst through the data write transistor T2 and the threshold compensation transistor T3, and when a voltage of the second terminal of the storage capacitor Cst reaches the sum of the data signal $V_{data}$ and the threshold voltage $V_{th1}$ of the drive transistor T1, the threshold compensation transistor T3 is turned off, that is, the charging is completed, in this situation, the data signal $V_{data}$ and the threshold voltage $V_{th1}$ of the drive transistor T1 can be stored at the second terminal of the storage capacitor Cst, and the stored data signal $V_{data}$ and the threshold voltage $V_{th1}$ of the drive transistor T1 can control the conduction degree of the drive transistor T1, thereby controlling the magnitude of a light emitting current flowing through the drive transistor T1, and the light emitting current flowing through the drive transistor T1 can determine the gray scale (i.e., light emitting intensity) of the light emitting component EL.

For example, in the embodiment illustrated in FIG. 2, the threshold compensation circuit 13 is an internal compensation circuit, but the present disclosure is not limited thereto, and the threshold compensation circuit 13 may also be an external compensation circuit, and the external compensation circuit may comprise, for example, a sensing circuit portion to sense the electrical characteristics of the drive transistor T1 or the electrical characteristics of the light emitting component EL, and a specific configuration of the sensing circuit portion can be referred to a conventional design, and is not described again here.

For example, as illustrated in FIG. 2, the pixel circuit 100 may further comprise a voltage drop compensation circuit 14. The voltage drop compensation circuit 14 is configured to write a reference voltage signal $V_{ref}$ to the first electrode of the drive transistor T1 during the data writing phase to compensate for the display voltage difference of the light emitting component EL caused by the power voltage drop (IR drop) of the display panel, and thereby improving display quality and display effect.

For example, the voltage drop compensation circuit 14 may comprise a voltage drop compensation transistor T6. A first electrode of the voltage drop compensation transistor T6 is electrically connected to a reference power terminal REF. A second electrode of the voltage drop compensation transistor T6 is electrically connected to the first electrode of the drive transistor T1, that is, the second electrode of the voltage drop compensation transistor T6 is also electrically connected to the first terminal of the storage capacitor Cst. A gate electrode of the voltage drop compensation transistor T6 is electrically connected to the second control terminal SC2.

For example, during the data writing phase, the second control terminal SC2 can provide a second control signal S2 to the gate electrode of the voltage drop compensation transistor T6 to turn on the voltage drop compensation transistor T6. The reference power terminal REF can provide a reference voltage signal $V_{ref}$ to the first electrode of the voltage drop compensation transistor T6, so that the reference voltage signal $V_{ref}$ charges the first terminal of the storage capacitor Cst through the voltage drop compensation transistor T6, and therefore the voltage of the first terminal of the capacitance Cst can be the reference voltage signal $V_{ref}$.

For example, as illustrated in FIG. 2, the pixel circuit 100 may further comprise a light emitting control circuit 15. The light emitting control circuit 15 is configured to control the drive circuit 10 to drive the light emitting component EL to emit light. The light emitting control circuit 15 may comprise a first light emitting control sub-circuit 151 and a second light emitting control sub-circuit 152. The first light emitting control sub-circuit 151 is disposed between the drive circuit 10 and the light emitting component EL, and is configured to control conduction or disconnection of an electrical connection between the drive circuit 10 and the light emitting component EL. The second lighting emitting control sub-circuit 152 is disposed between a first power voltage terminal V1 and the drive circuit 10, and is configured to control conduction or disconnection of an electrical connection between the first power voltage terminal V1 and the drive circuit 10.

For example, the first light emitting control sub-circuit 151 may comprise a first control transistor T7, and the second light emitting control sub-circuit 152 may comprise a second control transistor T5. A first electrode of the first control transistor T7 is electrically connected to the second electrode of the drive transistor T1, and a second electrode of the first control transistor T7 is electrically connected to a first terminal of the light emitting component EL (for example, a positive terminal of the light emitting component EL), and a gate electrode of the first control transistor T7 is electrically connected to the third control terminal SC3. A first electrode of the second control transistor T5 is electrically connected to the first power voltage terminal V1, a second electrode of the second control transistor T5 is electrically connected to the first electrode of the drive transistor T1, and a gate electrode of the second control transistor T5 is configured to receive a light emitting control signal. A second terminal of the light emitting component EL (for example, a negative terminal of the light emitting component EL) is electrically connected to a second power voltage terminal V2.

For example, in the embodiment illustrated in FIG. 2, the third control terminal SC3 can output a third control signal $S_3$ during a light emitting phase, the third control signal $S_3$ is the light emitting control signal, and the gate electrode of the second control transistor T5 may be electrically connected to the third control terminal SC3 to receive the light emitting control signal, that is, both the gate electrode of the first control transistor T7 and the gate electrode of the second control transistor T5 can be electrically connected to the third control terminal SC3, and the third control terminal SC3 can simultaneously transmit the same light emitting control signal to the gate electrode of the first control transistor T7 and the gate electrode of the second control transistor T5.

It should be noted that the first control transistor T7 and the second control transistor T5 can also be electrically connected to different control terminals, and light emitting control signals applied by the different control terminals are synchronized. The embodiments of the present disclosure do not limit this.

For example, during the light emitting phase, the light emitting control signal is simultaneously applied to the gate electrode of the first control transistor T7 and the gate electrode of the second control transistor T5, so that the first control transistor T7 and the second control transistor T5 are simultaneously turned on, and the first power voltage terminal V1, the second control transistor T5, the drive transistor T1, the first control transistor T7, the light emitting component EL and the second power voltage terminal V2 can form a loop, and the light emitting current is transmitted to the light emitting component EL through the turn-on second control transistor T5, the turn-on drive transistor T1 and the turn-on first control transistor T7 to drive the light emitting component EL to emit light.

For example, the first power voltage terminal V1 is a high voltage terminal, and can output a first power voltage signal $V_{dd}$, the second power voltage terminal V2 is a low voltage terminal, and can output a second power voltage signal $V_{ss}$. A voltage signal output by the high voltage terminal is greater than a voltage signal output by the low voltage terminal, that is, the first power voltage signal $V_{dd}$ can be greater than the second power voltage signal $V_{ss}$. However, the present disclosure is not limited thereto. In some embodiments, the first power voltage terminal V1 can also be a low voltage terminal, and the second power voltage terminal V2 can be a high voltage terminal. For example, the high voltage terminal can be electrically connected to a positive pole of a power supply. The low voltage terminal can be electrically connected to a negative pole of a power supply. The low voltage terminal can also be electrically connected to the ground (GND).

It should be noted that the specific structures of the data write circuit 11, the storage circuit 12, the threshold compensation circuit 13, the voltage drop compensation circuit 14, and the light emitting control circuit 15 can be set according to actual application requirements, and the embodiments of the present disclosure do not limit these specifically.

Figure 3:
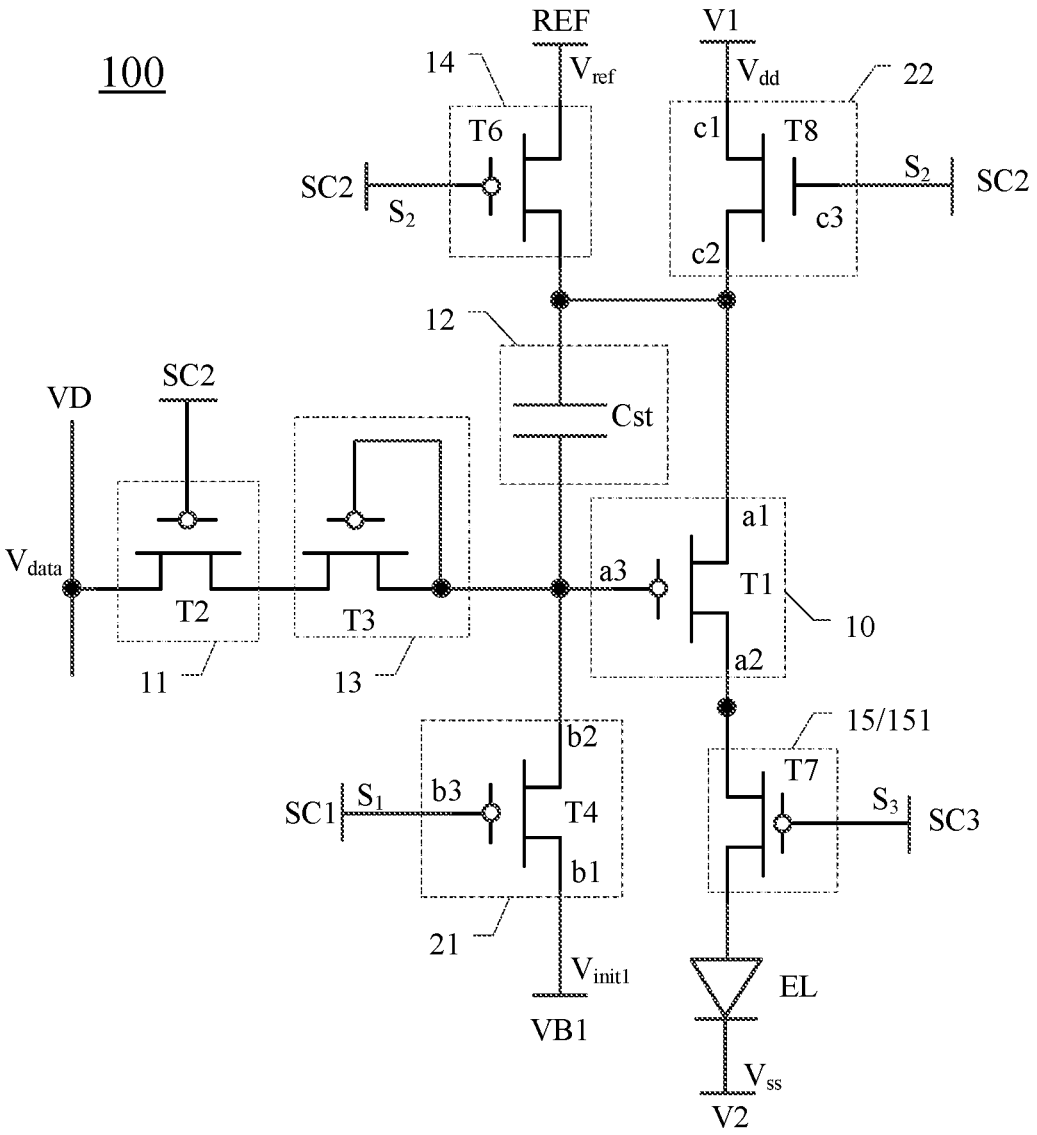
FIG. 3 is a structural schematic diagram of a pixel circuit provided by another embodiment of the present disclosure.

FIG. 3 is a structural schematic diagram of a pixel circuit provided by another embodiment of the present disclosure.

For example, in another embodiment, the second bias transistor illustrated in FIG. 2 can be further multiplexed into the second control transistor, and therefore one transistor can be saved in the pixel circuit (the transistor T5 of FIG. 2 is saved), to reduce production cost. As illustrated in FIG. 3, the second bias transistor T8 can be an N-type transistor and can be configured to write a second bias voltage signal $V_{init2}$ to the first electrode of the drive transistor T1 during the reset phase. In this situation, the gate electrode of the second bias transistor T8 is electrically connected to the second control terminal SC2, the first electrode of the second bias transistor T8 is electrically connected to the first power voltage terminal V1, and the second electrode of the second bias transistor T8 is electrically connected to the first electrode of the drive transistor T1. The first power voltage terminal V1 is configured to transmit a first power voltage signal $V_{dd}$ to the first electrode of the second bias transistor T8 during the reset phase. In this situation, the second bias voltage signal $V_{init2}$ is the first power voltage signal $V_{dd}$.

For example, during the reset phase, the first control terminal SC1 can output a first control signal $S_1$ to control the first bias transistor T4 to be turned on, and the second control terminal SC2 can output a second control signal $S_2$ to control the second bias transistor T8 to be turned on. The first bias voltage terminal VB1 is configured to output a first bias voltage signal $V_{init1}$, and the first bias voltage signal $V_{init1}$ can be transmitted to the gate electrode of the drive transistor T1 through the first bias transistor T4. The first power voltage terminal V1 can output a first power voltage signal $V_{dd}$, the first power voltage signal $V_{dd}$ is the second bias voltage signal $V_{init2}$, and the first power voltage signal $V_{dd}$ can be transmitted to the first electrode of the drive transistor T1 through the second bias transistor T8. In this situation, during the reset phase, the second control terminal SC2 is the bias control terminal BS, the first power voltage terminal V1 is the second bias voltage terminal VB2, and the first control signal $S_1$ and the second control signal $S_2$ are both bias control signals.

For example, during the light emitting phase, the second control terminal SC2 outputs a second control signal $S_2$, the third control terminal outputs a third control signal $S_3$, and the second control signal $S_2$ and the third control signal $S_3$ are used to control the second bias transistor T8 and the first control transistor T7 to be turned on simultaneously, thereby controlling the light emitting current to be transmitted to the light emitting component EL to drive the light emitting component EL to emit light. In this situation, during the light emitting phase, the second control signal $S_2$ and the third control signal $S_3$ are both light emitting control signals.

It should be noted that structures and connection modes of other circuits (for example, the first reset bias circuit 21, the data write circuit 11, the storage circuit 12, the threshold compensation circuit 13 and the voltage drop compensation circuit 14, etc.) in the embodiment illustrated in FIG. 3 can be the same as those of the corresponding circuits in the embodiment illustrated in FIG. 2, and details are not described here again.

For example, in the embodiment illustrated in FIG. 3, the gate electrode of the second bias transistor T8, the gate electrode of the data write transistor T2, and the gate electrode of the voltage drop compensation transistor T6 are all controlled by the same second control signal $S_2$. A type of the second bias transistor T8, a type of the data write transistor T2 and a type of the voltage drop compensation transistor T6 can be different. That is, where the second bias transistor T8 is an N-type transistor, the data write transistor T2 and the voltage drop compensation transistor T6 are both P-type transistors. However, the present disclosure is not limited in this aspect, the gate electrode of the second bias transistor T8, the gate electrode of the data write transistor T2 and the gate electrode of the voltage drop compensation transistor T6 can also be controlled by different control signals. In this situation, the type of the second bias transistor T8, the type of the data write transistor T2 and the type of the voltage drop compensation transistor T6 are not limited, that is, the type of the second bias transistor T8, the type of the data write transistor T2 and the type of the voltage drop compensation transistor T6 can be same (for example, are all P-type transistors), alternatively, can also be different. The present disclosure does not limit this.

It should be noted that, according to the characteristics of the transistors, the transistors can be divided into N-type transistors and P-type transistors. For the sake of clarity, the embodiments of the present disclosure illustrates the technical solution of the present disclosure by taking the transistors being P-type transistors as an example. However, the transistors in the embodiments of the present disclosure are not limited to P-type transistors. In addition to the drive transistor T1 and the threshold compensation transistor T3, those skilled in the art can implement the function of one or more transistors in the embodiments of the present disclosure by using N-type transistors according to actual requirements.

In the embodiments of the present disclosure, a first electrode of a transistor can be a source electrode or a drain electrode, and correspondingly, a second electrode of the transistor is a drain electrode or a source electrode. Therefore, the first electrode and the second electrode of all or part of the transistors in the embodiments of the present disclosure can be interchanged according to requirements. For different types of transistors, the control signals for their gate electrodes are also different. For example, for an N-type transistor, the N-type transistor is in a turn-on state where the control signal is a high level signal, and the N-type transistor is in a turn-off state where the control signal is a low level signal. For a P-type transistor, the P-type transistor is in a turn-on state where the control signal is a low level signal, and the P-type transistor is in a turn-off state where the control signal is a high level signal. The control signals in the embodiments of the present disclosure may vary correspondingly according to the types of the transistors.

Figure 4:
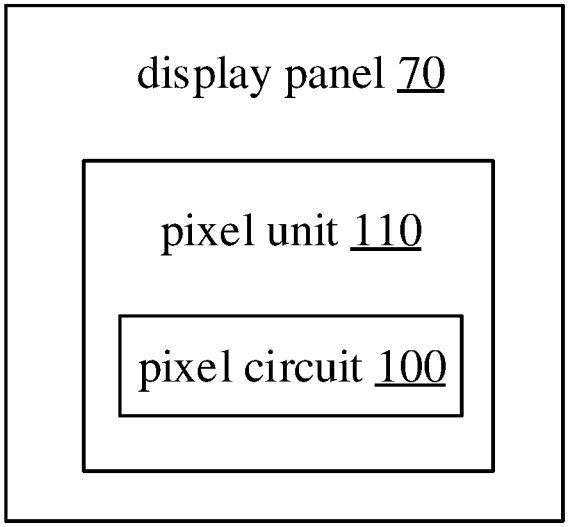
FIG. 4 is a schematic block diagram of a display panel provided by an embodiment of the present disclosure.

Embodiments of the present disclosure further provide a display panel. FIG. 4 is a schematic block diagram of a display panel provided by an embodiment of the present disclosure. As illustrated in FIG. 4, the display panel 70 comprises a plurality of pixel units 110, and the plurality of pixel units 110 may be arranged in an array. According to actual application requirements, the display panel 70 may comprise, for example, 1440 rows and 900 columns of pixel units 110. Each of the pixel units 110 may comprise the pixel circuit 100 described in any one of the above embodiments. In the pixel circuit 100, the drive circuit is in the bias state during the reset phase, so as to ameliorate a short-term afterimage phenomenon caused by the hysteresis effect, and improve the display quality of the display panel.

For example, the display panel 70 can be a rectangular panel, a circular panel, an elliptical panel, a polygonal panel, or the like. In addition, the display panel 70 can be not only a flat panel but also a curved panel or even a spherical panel.

For example, the display panel 70 can also have a touch function, that is, the display panel 70 can be a touch display panel.

Figure 5:
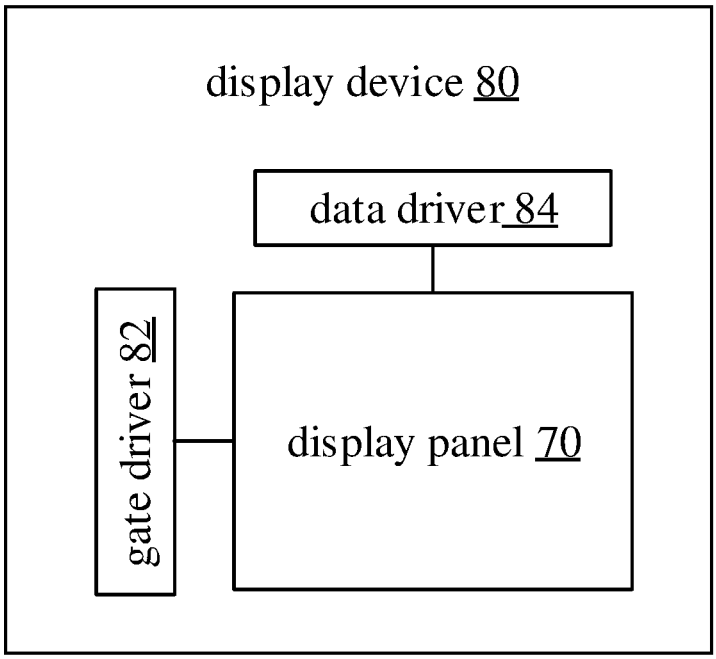
FIG. 5 is a schematic block diagram of a display device provided by an embodiment of the present disclosure.

Embodiments of the present disclosure further provide a display device. FIG. 5 is a schematic block diagram of a display device provided by an embodiment of the present disclosure. As illustrated in FIG. 5, the display device 80 comprises any one of the above display panels 70, and the display panel 70 is used for displaying images. Each of the pixel units in the display panel 70 comprises the pixel circuit in any one of the above embodiments. The pixel circuit comprises the drive circuit, the data write circuit, the storage circuit, the light emitting component, the first reset bias circuit, the second reset bias circuit, and so on. The first reset bias circuit and the second reset bias circuit are configured to control the drive circuit to be in the bias state during the reset phase, thereby ameliorating the short-term afterimage phenomenon caused by the hysteresis effect and improving display quality of the display device.

For example, the display device 80 may further comprise a gate driver 82. The gate driver 82 is also configured to be electrically connected to the data write circuit through a plurality of gate lines, so as to provide the second control signal to the data write circuit.

For example, the display device 80 may further comprise a data driver 84. The data driver 84 is configured to provide a data signal to the display panel 70. The data signal can be a voltage signal for controlling the light emitting intensity of a light emitting component of a corresponding pixel unit. The higher the voltage of the data signal is, the larger the gray scale is, thereby allow the light emitting intensity of the light emitting component to be larger.

For example, the gate driver 82 and the data driver 84 can be implemented by corresponding application specific integrated circuit chips respectively or can be directly manufactured on the display panel 70 by a semiconductor manufacture process.

For example, the display device 80 can be any product or component having a display function, such as a mobile phone, a tablet computer, a television, a display, a notebook computer, a digital photo frame, a navigator, and the like.

It should be noted that other components (such as a control device, an image data encoding/decoding device, a clock circuit, etc.) of the display device 80 should be understood by those skilled in the art, the components are not described here, and the components should not be construed as limitations to the present disclosure.

The embodiments of the present disclosure further provide a driving method of a pixel circuit, the driving method can be applied to any one of the above pixel circuits.

Figure 6:
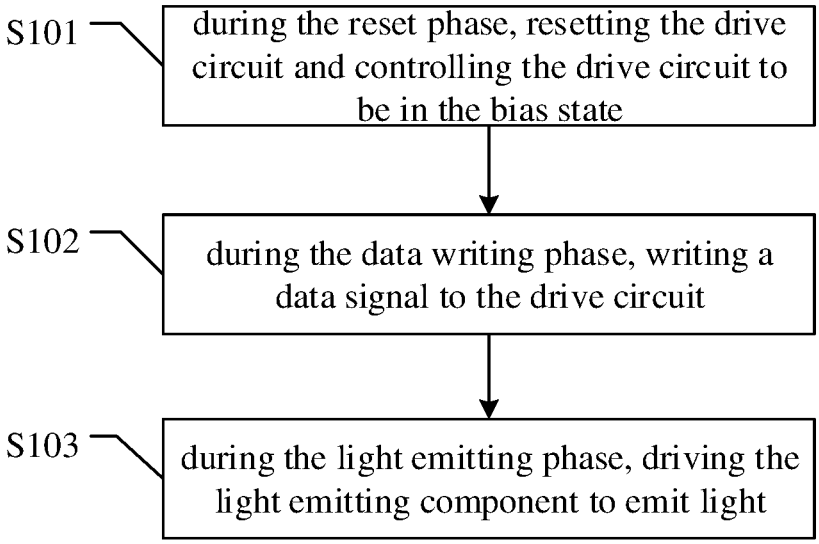
FIG. 6 is a schematic flow diagram of a driving method of a pixel circuit provided by an embodiment of the present disclosure.

FIG. 6 is a schematic flow diagram of a driving method of a pixel circuit provided by an embodiment of the present disclosure. As illustrated in FIG. 6, the driving method of the pixel circuit comprises following steps:

Step S101: during the reset phase, resetting the drive circuit and controlling the drive circuit to be in the bias state;

Step S102: during the data writing phase, writing a data signal to the drive circuit;

Step S103: during the light emitting phase, driving the light emitting component to emit light.

For example, taking the pixel circuit shown in FIG. 2 as an example, the pixel circuit 100 may comprise a light emitting component EL, a drive circuit 10, a first reset bias circuit 21, and a second reset bias circuit 22. The drive circuit 10 comprises a drive transistor T1, the first reset bias circuit 21 comprises a first bias transistor T4, and the second reset bias circuit 22 comprises a second bias transistor T8. Therefore, in the step S101, resetting the drive circuit and controlling the drive circuit to be in the bias state may comprise: writing a first bias voltage signal to a gate electrode of the drive transistor through the first bias transistor; and writing a second bias voltage signal to a first electrode of the drive transistor through the second bias transistor. A difference between the first bias voltage signal and the second bias voltage signal is configured to control the drive transistor to be in the bias state.

For example, the first bias voltage signal and the second bias voltage signal can be same. Alternatively, the first bias voltage signal is less than the second bias voltage signal.

For example, in the embodiment illustrated in FIG. 3, the second bias transistor T8 can be multiplexed into a second control transistor in a time sharing method, and the second bias voltage signal can be a first power voltage signal.

For example, in an example, the driving method of the pixel circuit provided by the embodiments of the present disclosure may comprise a threshold compensation operation. In the step S102, the driving method may further comprise: during the data writing phase, writing a threshold compensation signal to the gate electrode of the drive transistor through the threshold compensation circuit. Therefore, the pixel circuit can compensate for the threshold voltage of the drive transistor.

For example, in an example, the driving method of the pixel circuit provided by the embodiments of the present disclosure may comprise an IR drop compensation operation. In the step S102, the driving method may further comprise: during the data writing phase, writing a reference voltage signal to the first electrode of the drive transistor through the voltage drop compensation circuit. Therefore, the pixel circuit can compensate for the IR drop of the first supply voltage terminal.

For example, a timing diagram of the pixel circuit can be set according to actual requirements, the embodiments of the present disclosure do not limit the timing diagram specifically.

Figure 7:
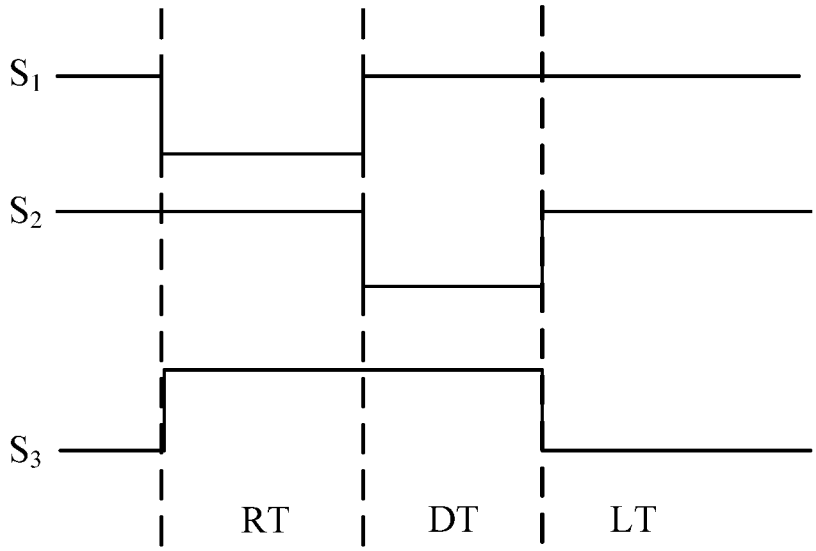
FIG. 7 is a schematic timing diagram of a pixel circuit provided by an embodiment of the present disclosure.

For example, in an example, FIG. 7 is an exemplary timing diagram of a driving method of the pixel circuit illustrated in FIGS. 2 and 3.

Figure 8A:
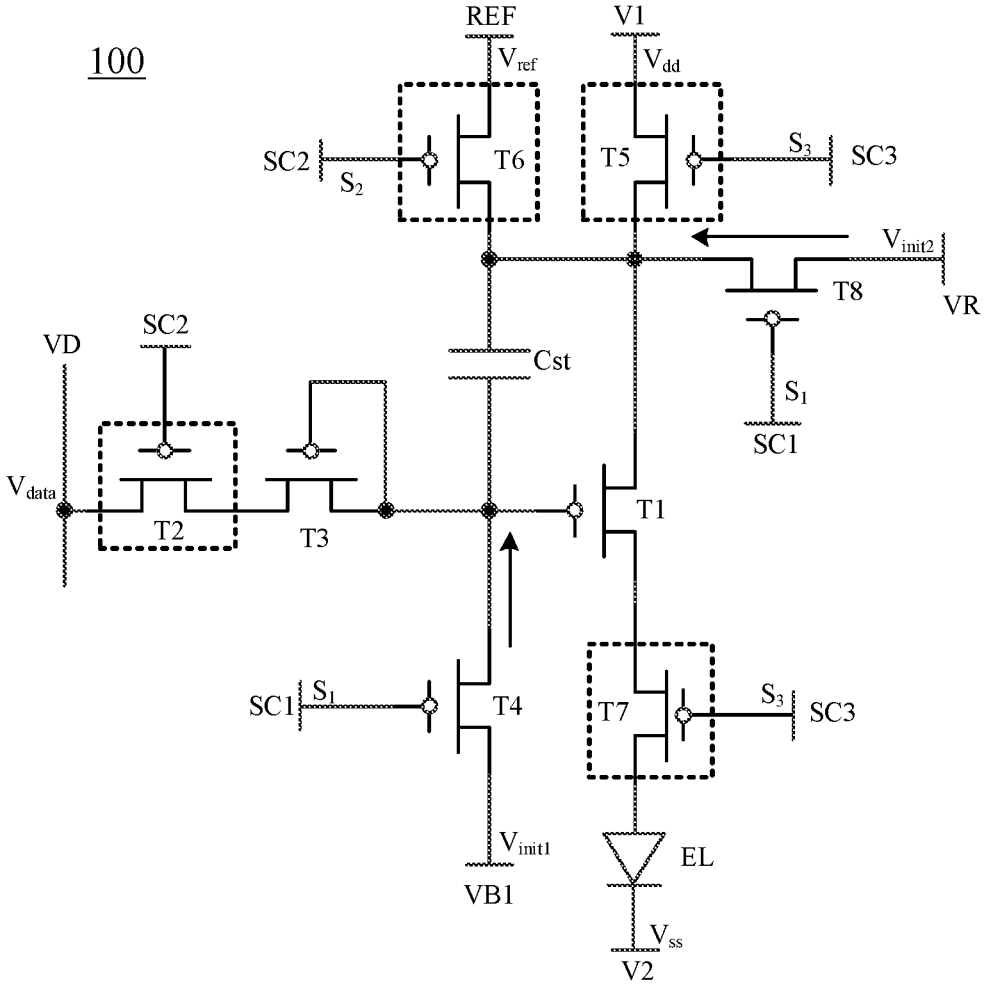
FIG. 8A is a schematic diagram of the pixel circuit shown in FIG. 2 during a reset phase.
Figure 8B:
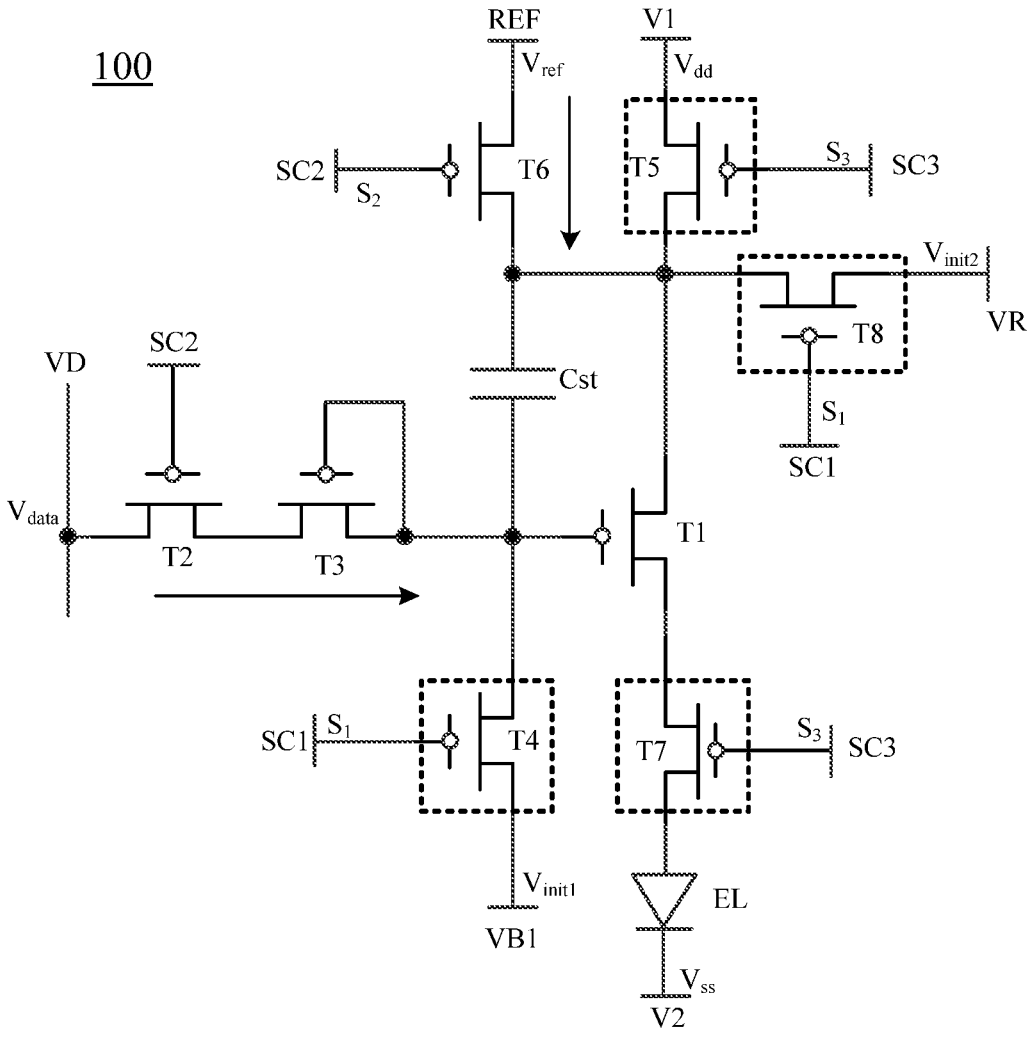
FIG. 8B is a schematic diagram of the pixel circuit shown in FIG. 2 during a data writing phase.
Figure 8C:
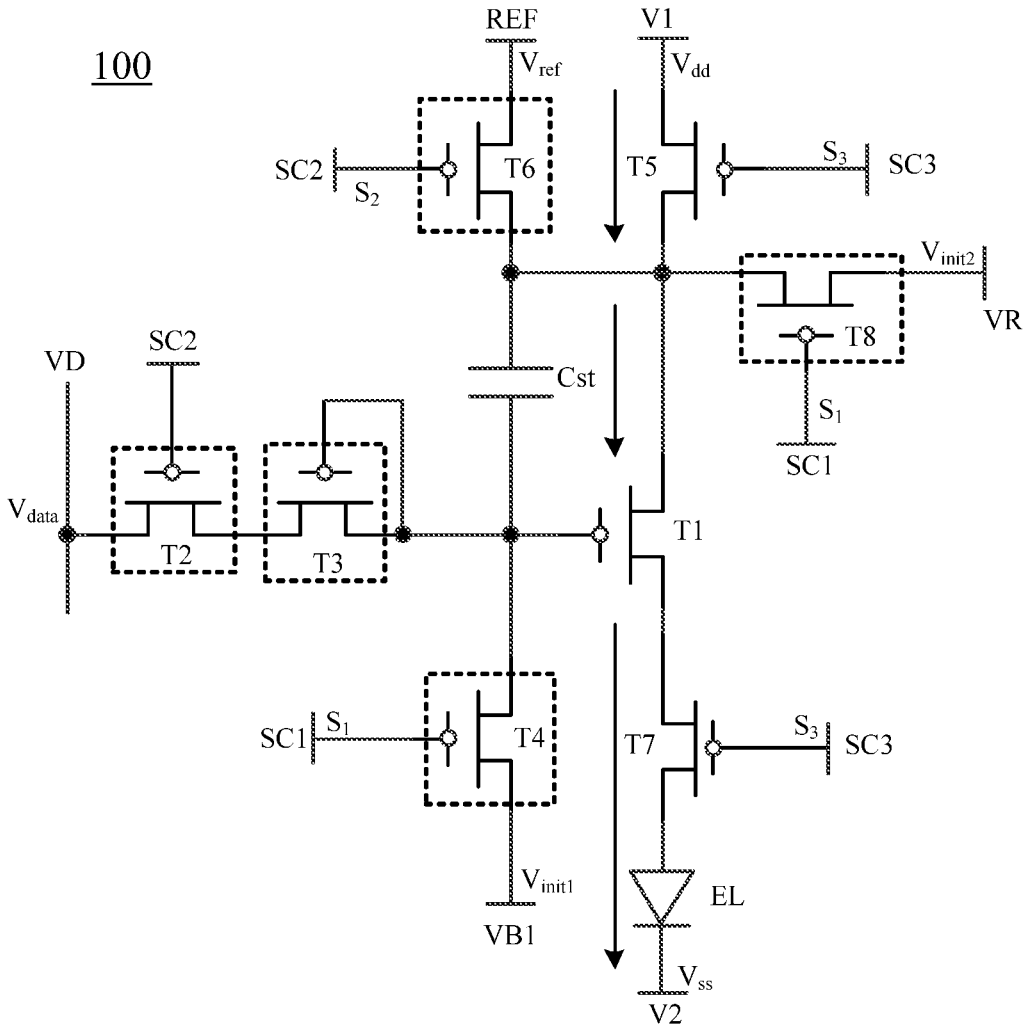
FIG. 8C is a schematic diagram of the pixel circuit shown in FIG. 2 during a light emitting phase.

For example, FIG. 8A to FIG. 8C are schematic diagrams of the pixel circuit illustrated in FIG. 2 during various operation phases. The operation flow of the driving method of the pixel circuit provided by the embodiments of the present disclosure is described in detail below with reference to FIG. 2, FIG. 7 and FIG. 8A to FIG. 8C.

It should be noted that, in FIG. 8A to FIG. 8C, dotted line frames placed at positions of the transistors indicates that the transistors are in turn-off states, and no symbols placed at positions of transistors indicates that the transistors are in turn-on states. Solid lines with arrows indicate flow directions of signals.

For example, as illustrated in FIG. 2, FIG. 7 and FIG. 8A, during a reset phase RT, the first control signal $S_1$ provided by the first control terminal SC1 is a low level signal, so that the first bias transistor T4 and the second bias transistor T8 are turned on. The second control signal $S_2$ provided by the second control terminal SC2 is a high level signal, and the third control signal $S_3$ (i.e., the light emitting control signal) provided by the third control terminal SC3 is a high level signal, so that the data write transistor T2, the voltage drop compensation transistor T6, the first control transistor T7 and the second control transistor T5 are all in turn-off states. The first bias voltage terminal VB1 outputs the first bias voltage signal $V_{init1}$, and the first bias voltage signal $V_{init1}$ is smaller than the sum of the threshold voltage $V_{th2}$ of the threshold compensation transistor T3 and the data signal $V_{data}$, so that the threshold compensation transistor T3 is in a turn-on state. The first bias voltage signal $V_{init1}$ is transmitted to the gate electrode of the drive transistor T1 through the first bias transistor T4, so that the voltage of the gate electrode of the drive transistor T1 is reset to the first bias voltage signal $V_{init1}$. The second bias voltage terminal VB2 (i.e., the reset voltage terminal VR) can output the second bias voltage signal $V_{init2}$, and the second bias voltage signal $V_{init2}$ is transmitted to the first electrode of the drive transistor T1 through the second bias transistor T8, so that the voltage of the first electrode of the drive transistor T1 is reset to the second bias voltage signal $V_{init2}$. In this situation, the drive transistor T1 can be in a turn-on state.

For example, in the example illustrated in FIG. 8A, during the reset phase RT, the drive transistor T1 is in a turn-on state. However, the present disclosure is not limited thereto, and during the reset phase RT, the drive transistor T1 can also be in a turn-off state. The first bias voltage signal $V_{init1}$ and the second bias voltage signal $V_{init2}$, for example, can be same, in this situation, the drive transistor T1 is in a turn-off state.

For example, as illustrated in FIG. 2, FIG. 7 and FIG. 8B, during a data writing phase DT, the first control signal $S_1$ is changed to a high level signal, the second control signal $S_2$ is changed to a low level signal, and the third control signal $S_3$ maintains a high level signal. In this situation, the first bias transistor T4, the second bias transistor T8, the first control transistor T7 and the second control transistor T5 are all in turn-off states, the drive transistor T1, the data write transistor T2, the voltage drop compensation transistor T6 and the threshold compensation transistor T3 are all turned on. Therefore, the data signal $V_{data}$ charges the second terminal of the storage capacitor Cst through the data write transistor T2 and the threshold compensation transistor T3 until the voltage of the second terminal of the storage capacitor Cst is $V_{data}+V_{th2}$. $V_{th2}$ is the threshold voltage of the threshold compensation transistor T3, and the threshold voltage $V_{th2}$ of the threshold compensation transistor T3 is the same as the threshold voltage $V_{th1}$ of the drive transistor T1, that is, the voltage of the second terminal of the storage capacitor Cst can be $V_{data}+V_{th1}$. In this situation, the voltage of the gate electrode of the drive transistor T1 is changed to $V_{data}+V_{th1}$. The reference voltage signal $V_{ref}$ charges the first terminal of the storage capacitor Cst through the voltage drop compensation transistor T6, that is, the voltage of the first terminal of the storage capacitor Cst can be the reference voltage signal $V_{ref}$, and in this situation, the voltage of the first electrode of the drive transistor T1 is changed to $V_{ref}$.

For example, as illustrated in FIG. 2, FIG. 7 and FIG. 8C, during a light emitting phase LT, the first control signal $S_1$ maintains a high level signal, the second control signal $S_2$ is changed to a high level signal, and the third control signal $S_3$ is changed to a low level signal. In this situation, the first bias transistor T4, the second bias transistor T8, the data write transistor T2, the voltage drop compensation transistor T6 and the threshold compensation transistor T3 are all in turn-off states, and the drive transistor T1, the first control transistor T7 and the second control transistor T5 are all turned on. Therefore, the first power voltage signal $V_{dd}$ output by the first power voltage terminal V1 can be transmitted to the first electrode of the drive transistor T1 through the second control transistor T5, and the voltage of the first electrode of the drive transistor T1 is changed to the first power voltage signal $V_{dd}$. Because of the bootstrap effect of the storage capacitor Cst, the voltage of the gate electrode of the drive transistor T1 is changed to $V_{data}+V_{th1}+V_{dd}-V_{ref}$.

It can be seen from the above analysis that during the three phases (the reset phase, the data writing phase, and the light emitting phase), the correspondence between the voltage of the gate electrode of the drive transistor T1 and the voltage of the first electrode of the drive transistor T1 can be as illustrated in Table 1 below.

TABLE 1

| Operation phases | gate electrode of drive transistor T1 | first electrode of drive transistor T1 |
|---|---|---|
| RT | $V_{init1}$ | $V_{init2}$ |
| DT | $V_{data}+V_{th1}$ | $V_{ref}$ |
| LT | $V_{data}+V_{th1}+V_{dd}-V_{ref}$ | $V_{dd}$ |

Figure 9A:
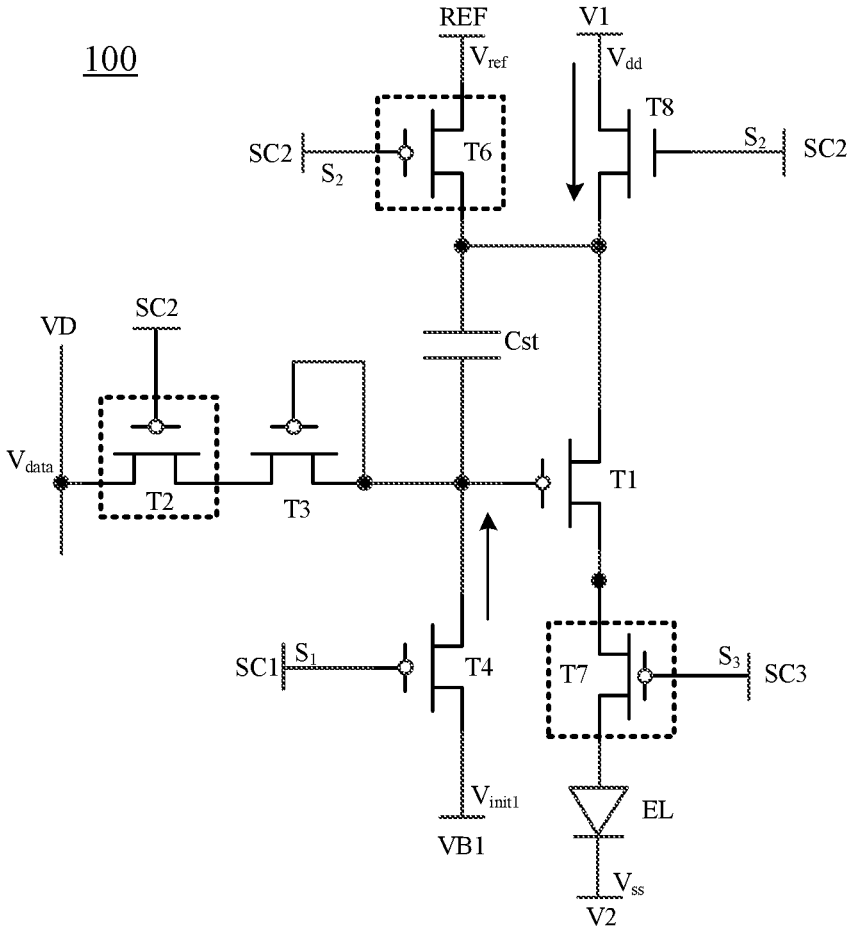
FIG. 9A is a schematic diagram of the pixel circuit shown in FIG. 3 during a reset phase.
Figure 9B:
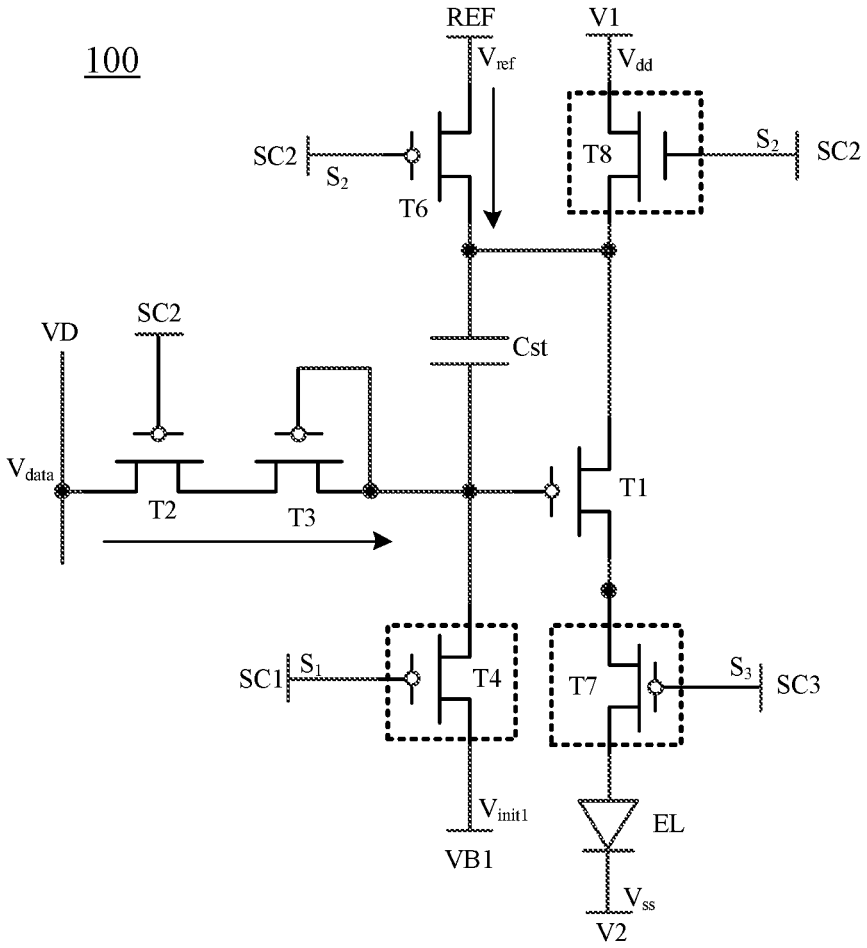
FIG. 9B is a schematic diagram of the pixel circuit shown in FIG. 3 during a data writing phase.
Figure 9C:
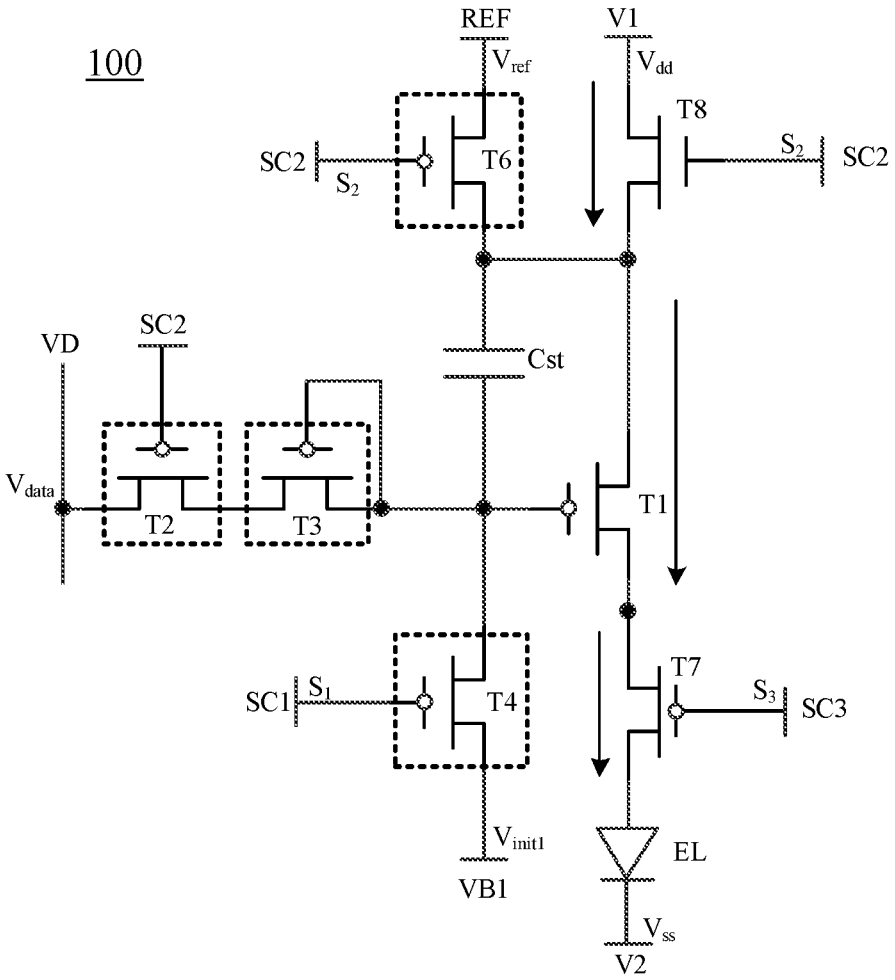
FIG. 9C is a schematic diagram of the pixel circuit shown in FIG. 3 during a light emitting phase.

For example, FIG. 9A to FIG. 9C are schematic diagrams of the pixel circuit illustrated in FIG. 3 during various operation phases. The operation flow of driving method of another pixel circuit provided by the embodiments of the present disclosure is described in detail below with reference to FIG. 3, FIG. 7 and FIG. 9A to FIG. 9C.

It should be noted that, in FIG. 9A to FIG. 9C, dotted line frames placed at positions of the transistors indicates that the transistors are in turn-off states, and no symbols placed at positions of the transistors indicates that the transistors are in turn-on states. Solid lines with arrows indicate flow directions of signals.

For example, as illustrated in FIG. 3, FIG. 7 and FIG. 9A, during a reset phase RT, the first control signal $S_1$ provided by the first control terminal SC1 is a low level signal, so that the first bias transistor T4 is turned on. The second control signal $S_2$ provided by the second control terminal SC2 is a high level signal, so that the second bias transistor T8 is turned on, and the data write transistor T2 and the voltage drop compensation transistor T6 are in turn-off states. The third control signal $S_3$ (i.e., the light emitting control signal) provided by the third control terminal SC3 is a high level signal, so that the first control transistor T7 is in a turn-off state. The first bias voltage terminal VB1 outputs the first bias voltage signal $V_{init1}$, and the first bias voltage signal $V_{init1}$ is smaller than the sum of the threshold voltage $V_{th2}$ of the threshold compensation transistor T3 and the data signal $V_{data}$, so that the threshold compensation transistor T3 is in a turn-on state. The first bias voltage signal is transmitted to the gate electrode of the drive transistor T1 through the first bias transistor T4, so that the voltage of the gate electrode of the drive transistor T1 is reset to the first bias voltage signal $V_{init1}$. The first power voltage terminal V1 (i.e., the second bias voltage terminal VB2) can output the first power voltage signal $V_{dd}$, and the first power voltage signal $V_{dd}$ is transmitted to the first electrode of the drive transistor T1 through the second bias transistor T8, so that the voltage of the first electrode of the drive transistor T1 is reset to the first power voltage signal $V_{dd}$. In this situation, the drive transistor T1 can be in a turn-on state.

For example, the first power voltage signal $V_{dd}$ can be greater than the first bias voltage signal $V_{init1}$, and the difference between the first bias voltage signal $V_{init1}$ and the first power voltage signal $V_{dd}$ is not larger than Vgs255 (the voltage difference between the gate electrode and the source electrode of the drive transistor T1 corresponding to the maximum gray scale), that is, $V_{init1}-V_{dd}$ is less than or equal to Vgs255.

For example, in the example illustrated in FIG. 9A, during the reset phase RT, the drive transistor T1 is in a turn-on state. However, the present disclosure is not limited thereto, and during the reset phase RT, the drive transistor T1 can also be in a turn-off state. For example, during the reset phase RT, is larger than the threshold voltage $V_{th1}$ of the drive transistor T1, in this situation, the drive transistor T1 is in a turn-off state.

For example, as illustrated in FIG. 3, FIG. 7 and FIG. 9B, during the data writing phase DT, the first control signal $S_1$ is changed to a high level signal, the second control signal $S_2$ is changed to a low level signal, and the third control signal $S_3$ maintains a high level signal. In this situation, the first bias transistor T4, the second bias transistor T8 and the first control transistor T7 are all in turn-off states, and the drive transistor T1, the data write transistor T2, the voltage drop compensation transistor T6 and the threshold compensation transistor T3 are all turned on. Therefore, the data signal $V_{data}$ charges the second terminal of the storage capacitor Cst through the data write transistor T2 and the threshold compensation transistor T3 until the voltage of the second terminal of the storage capacitor Cst is $V_{data}+V_{th2}$. $V_{th2}$ is the threshold voltage of the threshold compensation transistor T3, and the threshold voltage $V_{th2}$ of the threshold compensation transistor T3 is the same as the threshold voltage $V_{th1}$ of the drive transistor T1, that is, the voltage of the second terminal of the storage capacitor Cst can be $V_{data}+V_{th1}$. In this situation, the voltage of the gate electrode of the drive transistor T1 is changed to $V_{data}+V_{th1}$. The reference voltage signal $V_{ref}$ charges the first terminal of the storage capacitor Cst through the voltage drop compensation transistor T6, that is, the voltage of the first terminal of the storage capacitor Cst can be the reference voltage signal $V_{ref}$, and in this situation, the voltage of the first electrode of the drive transistor T1 is changed to $V_{ref}$.

For example, as illustrated in FIG. 3, FIG. 7 and FIG. 9C, during the light emitting phase LT, the first control signal $S_1$ maintains a high level signal, the second control signal $S_2$ is changed to a high level signal, and the third control signal $S_3$ is changed to a low level signal. In this situation, the first bias transistor T4, the data write transistor T2, the voltage drop compensation transistor T6 and the threshold compensation transistor T3 are all in turn-off states, and the drive transistor T1, the first control transistor T7 and the second bias transistor T8 are all turned on. Therefore, the first power voltage signal $V_{dd}$ output by the first power voltage terminal V1 can be transmitted to the first electrode of the drive transistor T1 through the second bias transistor T8, and the voltage of the first electrode of the drive transistor T1 is changed to the first power voltage signal $V_{dd}$. Because of the bootstrap effect of the storage capacitor Cst, the voltage of the gate electrode of the drive transistor T1 is changed to $V_{data}+V_{th1}+V_{dd}-V_{ref}$.

It can be seen from the above analysis that during the three phases (the reset phase, the data writing phase, and the light emitting phase), the correspondence between the voltage of the gate electrode of the drive transistor T1 and the voltage of the first electrode of the drive transistor T1 can be as illustrated in Table 2 below.

TABLE 2

| Operation phases | gate electrode of drive transistor T1 | first electrode of drive transistor T1 |
|---|---|---|
| RT | $V_{init1}$ | $V_{dd}$ |
| DT | $V_{data} + V_{th1}$ | $V_{ref}$ |
| LT | $V_{data} + V_{th1} + V_{dd} - V_{ref}$ | $V_{dd}$ |

Referring to Table 1 and Table 2, based on a saturation current formula of the drive transistor T1, during the light emitting phase LT, a light emitting current $I_{OLED}$ flowing through the drive transistor T1 can be expressed as:

$$\begin{aligned} I_{OLED} &= K(V_{GS} - V_{th1})^2 \\ &= K[(V_{data} + V_{th1} + V_{dd} - V_{ref}) - V_{dd} - V_{th1}]^2 \\ &= K(V_{data} - V_{ref})^2 \end{aligned}$$

In the above formula, $V_{GS}$ is the voltage difference between the gate electrode of the drive transistor T1 and the source electrode of the drive transistor T1, $V_{dd}$ is the first power voltage signal output by the first power voltage terminal V1, and $V_{th1}$ is the threshold voltage of the drive transistor T1. It can be seen from the above formula that the light emitting current $I_{OLED}$ is not affected by the threshold voltage $V_{th1}$ of the drive transistor T1 and the first power voltage signal of the first power voltage terminal V1, but only related to the reference voltage signal $V_{ref}$ output by the reference power terminal REF and the data signal $V_{data}$. The data signal $V_{data}$ is directly transmitted by the data signal terminal VD, and $V_{data}$ is independent of the threshold voltage $V_{th}$ of the drive transistor T1, so that the problem of the threshold voltage drift of the drive transistor T1 caused by the manufacture process and long-time operation can be solved. The reference voltage signal $V_{ref}$ is provided by the reference power terminal REF, which is independent of the IR drop of the first power voltage terminal V1, so that the problem of the IR drop of the display panel can be solved. In summary, the pixel circuit can ensure the accuracy of the light emitting current $I_{OLED}$, eliminate the influence of the threshold voltage of the drive transistor T1 and the IR drop on the light emitting current $I_{OLED}$, ensure the normal operation of the light emitting component EL, improve the uniformity of the display images, and improve the display effect.

For example, in the above formula, K is a constant, and K can be expressed as:

$$K=0.5\mu_n C_{ox}(W/L)$$

In the above formula, $\mu_n$ is the electron mobility of the drive transistor T1, $C_{ox}$ is the unit capacitance of the gate electrode of the drive transistor T1, W is the channel width of the drive transistor T1, and L is the channel length of the drive transistor T1.

It should be noted that setting manners of the reset phase, the data writing phase, and the light emitting phase can be determined according to actual application requirements, and the embodiments of the present disclosure do not limit this specifically.

Therefore, the driving method of the pixel circuit provided by the embodiments of the present disclosure allows the drive transistor to be in the bias state during the reset phase, so as to ameliorate the short-term afterimage problem caused by the hysteresis effect, and improve the display uniformity and display quality. In addition, the driving method of the pixel circuit provided by the embodiments of the present disclosure can also perform the threshold compensation operation and the voltage drop compensation operation, thereby compensating the threshold voltage drift of the drive transistor and the IR drop of the display panel, effectively improving the display effect of the display panel, and improving the display quality.

For the present disclosure, the following statements should be noted:

(1) The accompanying drawings involve only the structure(s) in connection with the embodiment(s) of the present disclosure, and other structure(s) can be referred to common design(s).

(2) In case of no conflict, features in one embodiment or in different embodiments can be combined to obtain new embodiments.

What are described above is related to the illustrative embodiments of the disclosure only and not limitative to the scope of the disclosure; the scopes of the disclosure are defined by the accompanying claims.

What is claimed is:

1. A pixel circuit, comprising: a light emitting component, a drive circuit, a first reset bias circuit, and a second reset bias circuit, wherein a control terminal of the drive circuit is electrically connected to a data signal terminal and a second terminal of the first reset bias circuit, a first terminal of the drive circuit is electrically connected to a second terminal of the second reset bias circuit, and a second terminal of the drive circuit is electrically connected to the light emitting component;

a control terminal of the first reset bias circuit is electrically connected to a first control terminal, and a first terminal of the first reset bias circuit is electrically connected to a first bias voltage terminal;

a control terminal of the second reset bias circuit is electrically connected to a bias control terminal, and a first terminal of the second reset bias circuit is electrically connected to a second bias voltage terminal; and the first reset bias circuit and the second reset bias circuit are configured to reset the drive circuit and control the drive circuit to be in a bias state during a reset phase;

wherein the drive circuit comprises a drive transistor, the first reset bias circuit comprises a first bias transistor, and the second reset bias circuit comprises a second bias transistor, the control terminal of the drive circuit is a gate electrode of the drive transistor, the first terminal of the drive circuit is a first electrode of the drive transistor, and the second terminal of the drive circuit is a second electrode of the drive transistor, the first terminal of the first reset bias circuit is a first electrode of the first bias transistor, the second terminal of the first reset bias circuit is a second electrode of the first bias transistor, and the control terminal of the first reset bias circuit is a gate electrode of the first bias transistor, and the first terminal of the second reset bias circuit is a first electrode of the second bias transistor, the second terminal of the second reset bias circuit is a second electrode of the second bias transistor, and the control terminal of the second reset bias circuit is a gate electrode of the second bias transistor;

the pixel circuit further comprises: a data write circuit, a storage circuit, and a voltage drop compensation circuit, the data write circuit is configured to write a data signal to the gate electrode of the drive transistor during a data writing phase; and the storage circuit is configured to store the data signal and maintain the data signal at the gate electrode of the drive transistor;

the voltage drop compensation circuit is configured to write a reference voltage signal to the first electrode of the drive transistor during the data writing phase.

2. The pixel circuit according to claim 1, further comprising a threshold compensation circuit, wherein the threshold compensation circuit is configured to write a threshold compensation signal to the gate electrode of the drive transistor during the data writing phase.

3. The pixel circuit according to claim 2, wherein the threshold compensation circuit comprises a threshold compensation transistor, the data write circuit comprises a data write transistor, and the storage circuit comprises a storage capacitor, a first electrode of the threshold compensation transistor is electrically connected to a second electrode of the data write transistor, a second electrode of the threshold compensation transistor and a gate electrode of the threshold compensation transistor are electrically connected with each other, and are electrically connected to the gate electrode of the drive transistor;

a first electrode of the data write transistor is electrically connected to the data signal terminal, and a gate electrode of the data write transistor is electrically connected to a second control terminal; and a first terminal of the storage capacitor is electrically connected to the first electrode of the drive transistor, and a second terminal of the storage capacitor is electrically connected to the gate electrode of the drive transistor.

4. The pixel circuit according to claim 1, wherein the voltage drop compensation circuit comprises a voltage drop compensation transistor, and the storage circuit comprises a storage capacitor, a first electrode of the voltage drop compensation transistor is electrically connected to a reference power terminal, a second electrode of the voltage drop compensation transistor is electrically connected to the first electrode of the drive transistor, and a gate electrode of the voltage drop compensation transistor is electrically connected to a second control terminal; and a first terminal of the storage capacitor is electrically connected to the first electrode of the drive transistor, and a second terminal of the storage capacitor is electrically connected to the gate electrode of the drive transistor.

5. The pixel circuit according to claim 1, further comprising a light emitting control circuit, wherein the light emitting control circuit is configured to control the drive circuit to drive the light emitting component to emit light.

6. The pixel circuit according to claim 5, wherein the light emitting control circuit comprises a first control transistor and a second control transistor, a first electrode of the first control transistor is electrically connected to the second electrode of the drive transistor, a second electrode of the first control transistor is electrically connected to the light emitting component, and a gate electrode of the first control transistor is electrically connected to a third control terminal; and a first electrode of the second control transistor is electrically connected to a first power voltage terminal, a second electrode of the second control transistor is electrically connected to the first electrode of the drive transistor, and a gate electrode of the second control transistor is configured to receive a light emitting control signal.

7. The pixel circuit according to claim 6, wherein the gate electrode of the second control transistor is electrically connected to the third control terminal to receive the light emitting control signal, the gate electrode of the second bias transistor is electrically connected to the first control terminal, the first electrode of the second bias transistor is electrically connected to a reset voltage terminal, the reset voltage terminal is the second bias voltage terminal, and the first control terminal is the bias control terminal.

8. The pixel circuit according to claim 7, wherein a signal output by the first bias voltage terminal is same as a signal output by the second bias voltage terminal.

9. The pixel circuit according to claim 6, wherein the second bias transistor is multiplexed into the second control transistor.

10. The pixel circuit according to claim 9, wherein the second bias transistor is an N-type transistor, the gate electrode of the second bias transistor is electrically connected to a second control terminal, the first power voltage terminal is the second bias voltage terminal, and the second control terminal is the bias control terminal.

11. A display panel, comprising the pixel circuit according to claim 1.

12. A display device, comprising the display panel according to claim 11.

13. A driving method of a pixel circuit, wherein the pixel circuit comprises a light emitting component, a drive circuit, a first reset bias circuit, and a second reset bias circuit, a control terminal of the drive circuit is electrically connected to a data signal terminal and a second terminal of the first reset bias circuit, a first terminal of the drive circuit is electrically connected to a second terminal of the second reset bias circuit, and a second terminal of the drive circuit is electrically connected to the light emitting component;

a control terminal of the first reset bias circuit is electrically connected to a first control terminal, and a first terminal of the first reset bias circuit is electrically connected to a first bias voltage terminal;

a control terminal of the second reset bias circuit is electrically connected to a bias control terminal, and a first terminal of the second reset bias circuit is electrically connected to a second bias voltage terminal; and the first reset bias circuit and the second reset bias circuit are configured to reset the drive circuit and control the drive circuit to be in a bias state during a reset phase;

the driving method comprises:

during the reset phase, resetting the drive circuit and controlling the drive circuit to be in the bias state;

during a data writing phase, writing a data signal to the drive circuit; and during a light emitting phase, driving the light emitting component to emit light;

wherein the drive circuit comprises a drive transistor, the first reset bias circuit comprises a first bias transistor, and the second reset bias circuit comprises a second bias transistor;

the resetting the drive circuit and controlling the drive circuit to be in a bias state comprises:

writing a first bias voltage signal to a gate electrode of the drive transistor through the first bias transistor; and writing a second bias voltage signal to a first electrode of the drive transistor through the second bias transistor, wherein the drive transistor is controlled to be in the bias state by a difference between the first bias voltage signal and the second bias voltage signal.

14. The driving method according to claim 13, wherein the first bias voltage signal and the second bias voltage signal are same.

15. The driving method according to claim 13, wherein a first electrode of the second bias transistor is electrically connected to a first power voltage terminal to receive a first power voltage signal, and the first power voltage signal is the second bias voltage signal.

16. The driving method according to claim 13, further comprising:

during the data writing phase, writing a threshold compensation signal to the gate electrode of the drive transistor through a threshold compensation circuit; and during the data writing phase, writing a reference voltage signal to the first electrode of the drive transistor through a voltage drop compensation circuit.

17. A pixel circuit, comprising: a light emitting component, a drive circuit, a first reset bias circuit, and a second reset bias circuit, wherein a control terminal of the drive circuit is electrically connected to a data signal terminal and a second terminal of the first reset bias circuit, a first terminal of the drive circuit is electrically connected to a second terminal of the second reset bias circuit, and a second terminal of the drive circuit is electrically connected to the light emitting component;

a control terminal of the first reset bias circuit is electrically connected to a first control terminal, and a first terminal of the first reset bias circuit is electrically connected to a first bias voltage terminal;

a control terminal of the second reset bias circuit is electrically connected to a bias control terminal, and a first terminal of the second reset bias circuit is electrically connected to a second bias voltage terminal;

the first reset bias circuit and the second reset bias circuit are configured to reset the drive circuit and control the drive circuit to be in a bias state during a reset phase;

the drive circuit comprises a drive transistor, the first reset bias circuit comprises a first bias transistor, and the second reset bias circuit comprises a second bias transistor, the control terminal of the drive circuit is a gate electrode of the drive transistor, the first terminal of the drive circuit is a first electrode of the drive transistor, and the second terminal of the drive circuit is a second electrode of the drive transistor, the first terminal of the first reset bias circuit is a first electrode of the first bias transistor, the second terminal of the first reset bias circuit is a second electrode of the first bias transistor, and the control terminal of the first reset bias circuit is a gate electrode of the first bias transistor, and the first terminal of the second reset bias circuit is a first electrode of the second bias transistor, the second terminal of the second reset bias circuit is a second electrode of the second bias transistor, and the control terminal of the second reset bias circuit is a gate electrode of the second bias transistor;

the pixel circuit further comprises a light emitting control circuit, the light emitting control circuit is configured to control the drive circuit to drive the light emitting component to emit light;

the light emitting control circuit comprises a first control transistor and a second control transistor, a first electrode of the first control transistor is electrically connected to the second electrode of the drive transistor, a second electrode of the first control transistor is electrically connected to the light emitting component, and a gate electrode of the first control transistor is electrically connected to a third control terminal; and a first electrode of the second control transistor is electrically connected to a first power voltage terminal, a second electrode of the second control transistor is electrically connected to the first electrode of the drive transistor, and a gate electrode of the second control transistor is configured to receive a light emitting control signal;

the second bias transistor is multiplexed into the second control transistor.

18. The pixel circuit according to claim 17, wherein the second bias transistor is an N-type transistor, the gate electrode of the second bias transistor is electrically connected to a second control terminal, the first power voltage terminal is the second bias voltage terminal, and the second control terminal is the bias control terminal.

* * * * *